United States Patent [19]

Pons

[11] Patent Number: 4,641,062

[45] Date of Patent: Feb. 3, 1987

[54] METHOD AND APPARATUS FOR ADJUSTING THE STATIC CONVERGENCE AND PURITY OF COLOR TELEVISION TUBES

[75] Inventor: Claude Pons, Grottaferrata, Italy

[73] Assignee: Videocolor, Montrouge, France

[21] Appl. No.: 787,717

[22] Filed: Oct. 17, 1985

Related U.S. Application Data

[63] Continuation of Ser. No. 603,046, Apr. 23, 1984.

[30] Foreign Application Priority Data

Apr. 26, 1983 [FR] France ..... 83 06832

[51] Int. Cl.[4] ..... H01J 29/70; H01J 29/76

[52] U.S. Cl. ..... 315/368; 315/370; 358/10

[58] Field of Search ..... 315/368, 370; 358/10; 335/212, 213

[56] References Cited

U.S. PATENT DOCUMENTS

| | | | |
|---|---|---|---|
| 3,348,177 | 10/1967 | Wood | 335/213 |
| 4,001,877 | 1/1977 | Simpson | 358/10 |
| 4,105,983 | 8/1978 | Barten et al. | 335/212 |
| 4,138,628 | 2/1979 | Smith | 315/368 |
| 4,390,815 | 6/1983 | Key et al. | 315/368 |

FOREIGN PATENT DOCUMENTS

| | | |
|---|---|---|
| 62281 | 10/1982 | European Pat. Off. . |
| 2907898 | 9/1980 | Fed. Rep. of Germany . |
| 2306522 | 10/1976 | France . |
| 2399120 | 2/1979 | France . |
| 2502386 | 9/1982 | France . |
| 2001830 | 2/1979 | United Kingdom . |

*Primary Examiner*—Theodore M. Blum

*Attorney, Agent, or Firm*—Pollock, Vande Sande & Priddy

[57] ABSTRACT

An apparatus for adjusting the static convergence and/or the purity of a color television tube particularly of the kind having a perforated mask. A magnetizable ring encircles the neck of the tube. Poles are formed in this ring by means of coils displaceable in such manner that these coils and/or their cores are applied against the periphery of the magnetizable ring. The application of the coils or of their cores against the ring renders constant the relationship between the current supplied to these coils and the intensity of magnetization obtained.

2 Claims, 2 Drawing Figures

METHOD AND APPARATUS FOR ADJUSTING THE STATIC CONVERGENCE AND PURITY OF COLOR TELEVISION TUBES

This application is a continuation of application Ser. No. 603,046, filed Apr. 23, 1984.

BACKGROUND OF THE INVENTION

The present invention relates to a method and an apparatus for adjusting the static convergence and/or purity of color television tubes, in particular of the kind comprising a shadow mask.

It is known that a color television tube comprises a screen on which are deposited luminescent substances (or phosphors) arranged in triads, each dot, referred to as a luminophor, of this triad displaying a primary color when it is excited, for example being red, green or blue. The excitation is performed by means of a beam of electrons generated by an electron gun allocated to a particular color. The three electron beams have different directions so that the three pencils of these beams which pass through one and the same aperture of the mask have different impact points on the screen, each point of impact being a part only of a luminophor, referred to as a "chromatome". The adjustment which consists in adjusting the direction of each beam so that it excites only the color for which it is provided, is referred to as the purity adjustment.

Although the purity adjustment may be correct, the color reproduction is not necessarily perfect; it is necessary, moreover, that the chromatomes of each triad should not be spaced too far apart from each other. As a matter of fact, in order that an eye receives the impression that it sees a white or uniform spot in the presence of three luminous dots of the three primary colors, these luminous dots must be close enough to each other. To secure this result, matters are organized so that the impact points of the three beams are superimposed on the screen in the absence of the mask. The setting which permits securing this result is referred to as the convergence setting.

The purity and convergence adjustments are obtained on the one hand by means of constant magnetic fields generated by one or more magnets and, on the other hand, by correct positioning of the deflector (intended to displace the electron beams for performing the scanning operation) with respect to the remainder of the tube.

The adjustment for purity and for static convergence (that is to say the convergence at the center of the screen, without scanning) is effected by means of permanent magnets. The invention relates to an adjustment of this nature.

It relates more particularly to the adjustment of the purity and of the static convergence of the tubes which comprise a magnetized ring around the neck of the tube. This ring is formed, for example, by a pliable material referred to as "plastoferrite" which is ferrite embedded in a plastics material.

In order to perform purity and static convergence adjustments, a particular number of poles are established in the magnetizable ring for example, eight, which are uniformly spread around the axis of the tube, the intensity of magnetization, that is to say the magnetic induction, of each pole being a function of the whole of the corrections which are to be performed.

The magnetization of these poles has been performed up to the present by means of coils having a particular position in a fixed support (French Pat. No. 2,399,120) or in a clamp-shaped support (French Pat. No. 2,502,386). However, since the magnetization rings are not all of precisely the same dimensions, and also the necks of the tubes are not all of identical dimensions, the intensity of the current to be supplied to each coil for magnetization of the ring—in order to obtain the purity and static convergence corrections—varies from one tube to another. The result is that the adjustment differs between one tube and another, which is troublesome as regards mass-production. Moreover, this variation renders it difficult to establish automation of the adjustment.

The present invention seeks to overcome this disadvantage.

SUMMARY OF THE INVENTION

The present invention is characterized in that, for performing the magnetization of the poles of the ring for purity and static convergence correction, each magnetizing coil and/or the core on which it is wound, is/are applied against this ring. In this manner, a current of given intensity within a coil generates a magnetic pole having a well defined induction. This reproducibility facilitates adjustment and permits automation. As a matter of fact, a preliminary calibrating action makes it possible to determine a chart, for each kind of tube, indicating the intensity of the current to be supplied to each coil in order to correct a static convergence or purity defect, as a function of the value of this defect; whereas a calibrating operation of this nature cannot be performed or is insufficiently precise with the methods known earlier.

Each coil is preferably situated at the extremity of a jaw.

In order that the magnetization of the ring may be performed automatically to secure the purity and static convergence adjustment, use is made of a device for measuring purity and static convergence errors and (the relationship between each error and the current to be supplied to each coil being known by virtue of the said preliminary calibration) a calculator device is utilized such that each coil may receive the quantity of energy it requires to perform the correction.

To measure static convergence errors, use may be made of the device described in French Pat. No. 8007412, and to measure purity errors, use may be made of the device described in U.S. Pat. No. 4,001,877. These documents are herein incorporated by reference.

BRIEF DESCRIPTION OF THE DRAWINGS

Other features and advantages of the invention will appear from the following description of a preferred embodiment, given with reference to the accompanying drawings, in which.

DESCRIPTION OF THE PREFERRED EMBODIMENT

A flexible and magnetizable ring 10, for example of plastoferrite, is disposed around the neck 11 of a color television tube. In one embodiment, this tube is of the kind comprising a perforated mask and three guns in line, that is to say generating three electron beams in one and the same plane.

The ring 10 is intended to be magnetized so as to generate magnetic fields which deflect the electron beams so as to secure the purity of the colors, that is to say so that the beam from the gun allocated to the blue phosphors reaches only the phosphors of this color, and similarly, the guns intended for excitation of the red and green phosphors respectively generate beams reaching only these phosphors. The magnetic fields generated by the magnets formed within the ring 10 equally have the purpose of adjusting the static convergence, that is to say they ensure that the three beams have the same trace at the center of the screen in the absence of scanning, assuming the perforated mask to has been removed. In this embodiment, eight poles are established for performing these adjustments.

Figure 1:
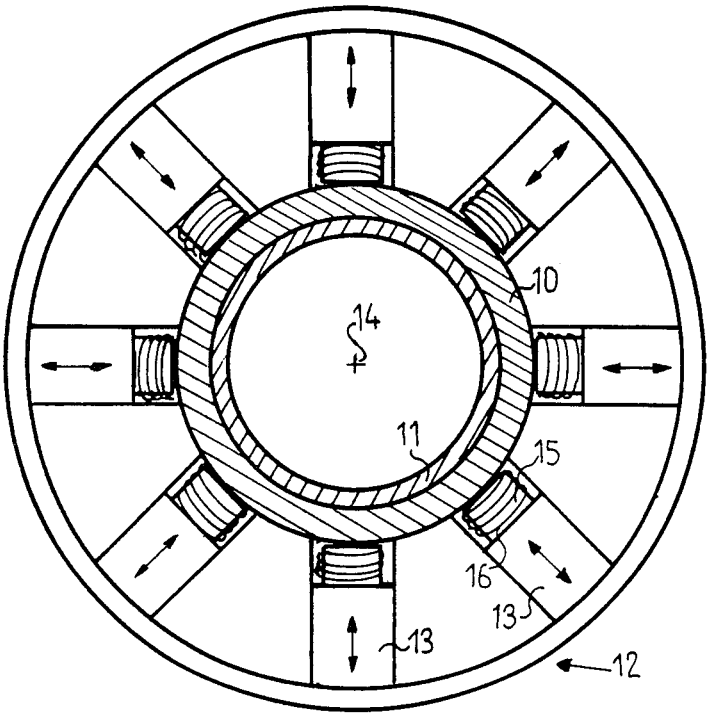
FIG. 1 is a diagram of one embodiment of a purity and static convergence adjustment device in accordance with the invention.

For this purpose, the device 12 (FIG. 1) according to the invention comprises eight jaws 13 of which each is guided radially, that is perpendicular to the axis 14 of the tube, and has a narrowed extremity 15 around which is wound a magnetizing coil 16.

The jaws 13 consequently have a dual task: on the one hand, they permit the application of the pliable ring 10 against the periphery of the neck 11 (this ring however having been bonded to the neck 11 beforehand), and on the other hand, they apply the coils 16 directly against the outer surface of the ring 10. Furthermore, the extremity 15 forms a magnetic core. It should be noted that it is not essential to apply the coils against the ring 10; it is sufficient for the cores 15 to be in contact with this ring. To secure maximum efficiency however, as in the case of the example, it is preferable that the extremity of the coil 16 should be in contact with the ring 10 at the same time as the extreme surface of the core 15. In other words, the terminal turn of the coil 16 is in the same plane as the extremity of the core 15, in this example.

Figure 2:
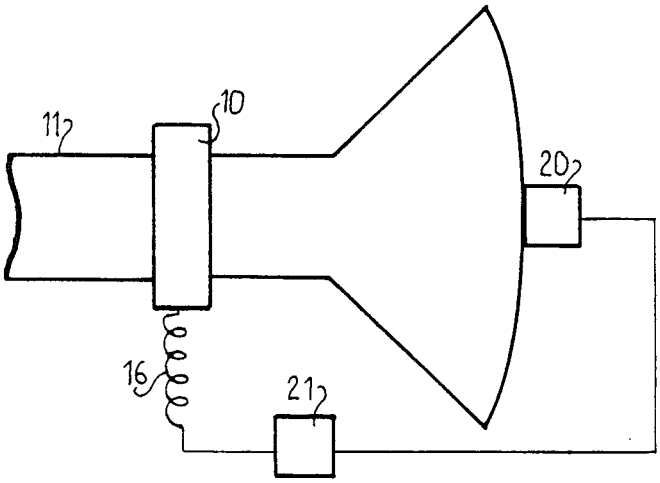
FIG. 2 is a diagram of an arrangement in which the device of FIG. 1 is utilized.

The following procedure is adopted to perform the initial purity and static convergence adjustment. A device 20 (FIG. 2) for measuring defects on the screen produces electrical signals which are fed to a computer 21 programmed so as to deliver values for the currents which are to be fed to the coils 16 to secure a resultant action correcting the defects measured. The program may easily be developed by one versed in the art. As a matter of fact, a preliminary calibrating operation makes it possible to establish the relationship prevailing between the purity and static convergence defects measured on the screen and the currents to be supplied to each coil to secure correction of the errors. This calibration is rendered possible by elimination of the air gap between the coils 16 and the plastoferrite 10, whereas in the methods previously employed, the magnetizing coils were stationary which in view of the variations in size of the diameters of the necks of the tubes and of the dimensions of the rings 10, did not permit precise calibration.

The jaws are moved away from the ring 10 once the adjustment has been completed.

The adjustment may be performed in a wholly automatic manner, a motor then being provided, with corresponding control means, for moving the jaws 13 towards and away from the rings 10.

What is claimed is:

1. Apparatus for adjusting purity and static convergence of a color television tube having a magnetizable ring encircling the neck thereof, comprising:

a plurality of bearing members each displaceable perpendicularly to the longitudinal axis of the tube, each of the bearing members having a core extending from one end thereof;

a corresponding plurality of coils wound around the cores of the bearing members in a one-to-one relationship;

an energization means connected to each of the coils for energizing the coils to produce magnetic poles within the magnetizable ring; and electromagnetic bi-directional actuating means connected to the bearing members for individually radially displacing each of the coils and cores against the periphery of the magnetizable ring and in constant contact therewith, irrespective of the diameter of the ring, during the purity and convergence adjustments, even after repeated adjustments, so that the relationship between currents applied to the coils and the intensity of magnetization is constant, the actuating means further withdrawing each of the bearing members radially away from the periphery of the magnetizable ring after the completion of the adjustments, thereby facilitating easy removal of the apparatus.

2. Apparatus according to claim 1, further comprising:

means for measuring purity and static convergence defects on the screen of the television tube and producing signals representative of these defects; and computer means connected to the measuring means for receiving the signals therefrom and generating current pulses of different intensities corresponding to the values of the defect signals, the computer means further feeding the current pulses to the coils for correcting the defects.

* * * * *